US006614162B2

(12) United States Patent
Kim et al.

(10) Patent No.: US 6,614,162 B2
(45) Date of Patent: Sep. 2, 2003

(54) PANEL OF CATHODE RAY TUBE

(75) Inventors: Wan Kim, Yongin (KR); Do-hun Pyun, Yongin (KR); Tae-il Yoon, Suwon (KR); Jeong-in Yoo, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 192 days.

(21) Appl. No.: 09/793,398

(22) Filed: Feb. 27, 2001

(65) Prior Publication Data

US 2001/0030503 A1 Oct. 18, 2001

(30) Foreign Application Priority Data

Feb. 29, 2000 (KR) ..... 2000-10057

(51) Int. Cl.[7] ..... H01J 29/10
(52) U.S. Cl. ..... 313/461
(58) Field of Search ..... 313/461, 477 R

(56) References Cited

U.S. PATENT DOCUMENTS 4,786,840 A 11/1988 Ragland, Jr.
4,887,001 A 12/1989 D'Amato et al.
5,386,174 A 1/1995 Ishii
5,814,933 A 9/1998 Iwata et al.
5,837,026 A 11/1998 Sugawara et al.
5,964,364 A 10/1999 Shimizu et al.
6,046,540 A 4/2000 Nakamura
6,066,914 A 5/2000 Shimizu et al.
6,121,723 A 9/2000 Sugawara et al.
6,133,681 A 10/2000 Nakamura et al.
6,157,124 A 12/2000 Wakasono
6,232,712 B1 * 5/2001 Pyun et al. ..... 313/477 R
6,448,706 B1 * 9/2002 Kawamura et al. ..... 313/477 R

* cited by examiner

*Primary Examiner*—Sandra O'Shea
*Assistant Examiner*—Sumati Krishnan
(74) *Attorney, Agent, or Firm*—Robert E. Bushnell, Esq.

(57) ABSTRACT

A cathode ray tube with a panel that has a thickness of the central portion of an effective area of a screen surface that is TC, a thickness of a vertical edge that is TV, a thickness of a horizontal edge portion that is TH, and a thickness of an edge in a diagonal direction that is TD. The respective values of TC, TV, TH and TD satisfy the expression (TH−TC)+(TV−TC)+(TD−TC)<TC/3, and the radius of curvature in the diagonal direction of the outer surface of the effective area is 1450 mm or more. Thus, by limiting the difference in thickness of the central portion and the peripheral portion of the effective screen area of the panel and the curvature radius of the inner and outer surfaces of the effective screen, the weight of the panel is reduced and an increase of an incident angle caused by flatness of the screen panel is prevented so that a convergence feature of an electron beam is improved. Also, emotional sense of flatness according to the flatness of the screen surface can be improved.

20 Claims, 4 Drawing Sheets

PANEL OF CATHODE RAY TUBE

CLAIM OF PRIORITY

This application makes reference to, incorporates the same herein, and claims all benefits accruing under 35 U.S.C. §119 from my application PANEL OF CATHODE RAY TUBE filed with the Korean Industrial Property Office on the Feb. 29, 2000 and there duly assigned Ser. No. 10057/2000.

BACKGROUND OF THE INVENTION

1. Field of the Invention

The present invention relates to a cathode ray tube (CRT), and more particularly, to a panel of a CRT having improved curvature and thickness of a screen surface where an image is formed.

2. Description of the Related Art

A typical color CRT includes a panel having a screen surface where a fluorescent film which emits light in three colors is formed, and a funnel coupled to the panel forming a housing of the CRT. Recent exemplars in the art include the Cathode Ray Tube With Specifically Shaped Inside Picture Area of H. Wakasono, U.S. Pat. No. 6,157,124, the Color Cathode Ray Tube of N. Shimizu, et al., U.S. Pat. No. 6,066,914, the Color Picture Tube Device Having Contoured Panel And Auxiliary Coil For Reducing Apparent Screen Distortions of K. Nakamura, et al., U.S. Pat. No. 6,133,681, and the Color Picture Tube of K. Nakamura, U.S. Pat. No. 6,046,540. A shadow mask frame assembly that is perforated by a plurality of holes which accommodate passage of electronic beams, is installed on the inner surface of the panel to be separated by a predetermined distance from the fluorescent film. An electron gun and a deflection yoke are installed at a neck portion and a cone portion of the funnel, respectively.

In the CRT having the above structure, a screen surface of the panel is formed such that the thickness of a central portion thereof is thinner than the thickness of a peripheral portion, in consideration of the high vacuum in the CRT and atmospheric pressure. The difference in thickness between the central portion and the peripheral portion of the screen surface causes a difference in brightness between the central portion and the peripheral portion of an image formed as the fluorescent film coated on the inner surface of the screen surface is excited. To overcome this difference in brightness, the current density of an electron beam impingent upon a fluorescent substance at the central portion of the screen surface is customarily reduced to lower the brightness of the central portion. In this case, the brightness of the overall image formed by the CRT is lowered. When it is desired to improve the brightness of the image, because both the sense of flatness of the outer surface of the panel and the convergence correction of the deflection yoke corresponding to the curvature of the inner surface of the panel must be taken into consideration, the design of the panel is, in my opinion, unnecessarily complex.

SUMMARY OF THE INVENTION

It is therefore, an object of the present invention to provide an improved cathode ray tube and process for manufacturing cathode ray tubes.

It is another object to provide a thinner panel for a cathode ray tube and a process for manufacturing a thinner panel for a cathode ray tube.

It is still another object to provide an improved panel and process for manufacturing panels for cathode ray tubes.

It is yet another object to provide a process for manufacturing and a panel that exhibits greater uniformity in cross-sectional thickness.

It is still yet another object to provide a process for manufacturing and a panel produced by that process that exhibits a greater degree of uniformity of brightness across the entirety of visual image formed on its screen surface.

It is a further object to provide a panel of a CRT in which the panel is lighter but is not susceptible to either implosion or to deviation of brightness attributable to differences in thickness of the panel.

These and other objects may be attained with an improved cathode ray tube and process for manufacturing a cathode ray tube. The panel is manufactured to provide that the thickness of the central portion of an effective area of the screen surface is TC, the thickness of a vertical edge of the screen surface is TV, the thickness of a horizontal edge of the screen surface is TH, and the thickness of an edge in a diagonal direction along the screen surface is TD. These respective values of thickness satisfy the expression of inequality:

$$(TH-TC)+(TV-TC)+(TD-TC)<TC/3,$$

and the radius of curvature of the outer surface when measured along the diagonal direction of the effective area is 1,450 millimeters or more.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, and wherein.

DETAILED DESCRIPTION OF THE INVENTION

Figure 1:
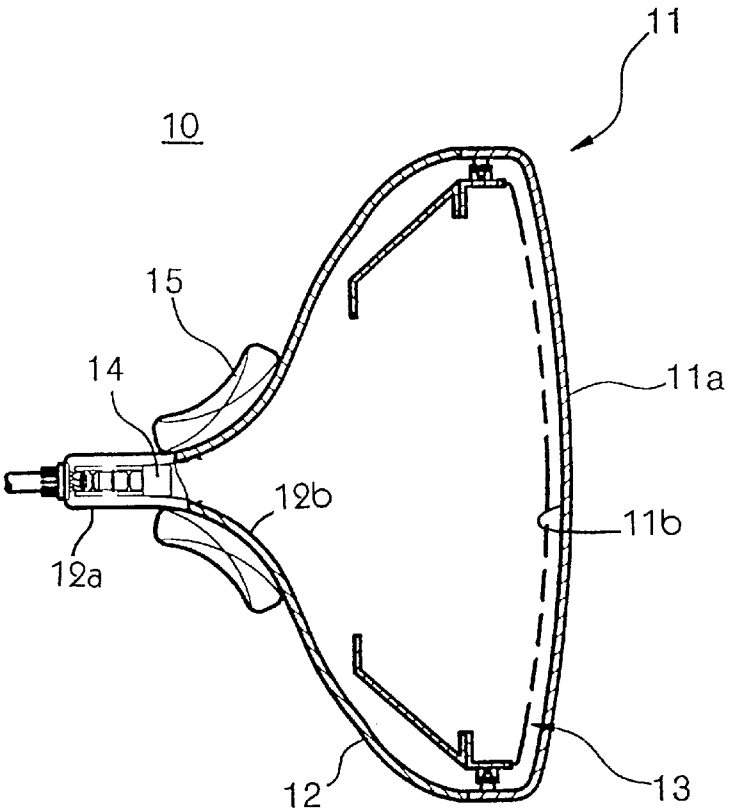
FIG. 1 (PRIOR ART)
FIG. 1 is a cross-sectional view showing a color CRT.

Turning now to the drawings, FIG. 1 illustrates the typical color CRT 10 that is exemplary of contemporary practice in the art, which includes a panel 11 having a screen surface 11*a* where a fluorescent film 11*b* which emits light in three colors is formed, and a funnel 12 that is coupled to the panel 11 to form a housing for the CRT. A shadow mask frame assembly 13 that is perforated by a plurality of holes that accommodate passage of electron beams is installed on the inner surface of the panel 11 and is separated by a predetermined distance from fluorescent film 11*b*. An electron gun 14 and a deflection yoke 15 are installed respectively at a neck portion 12*a* and a cone portion 12*b* of funnel 12.

Figure 2:
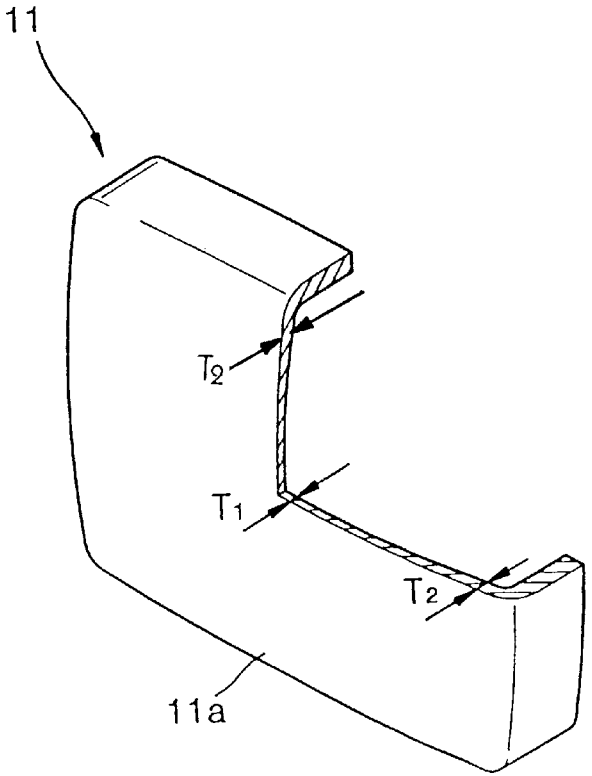
FIG. 2 (PRIOR ART)
FIG. 2 is a partially cut-away perspective view of the panel shown in FIG. 1.

Turning now to FIG. 2, in cathode ray tube 10, a screen surface 11*a* of the panel 11 is formed such that the thickness T1 of a central portion thereof is thinner than the thickness T2 of a peripheral portion, in order to accommodate the high vacuum in the CRT and atmospheric pressure. The difference in thickness between the central portion and the peripheral portion of the screen surface 11*a* causes a difference in brightness to occur between the central portion and the peripheral portion of an image formed as the fluorescent film coated on the inner surface of the screen surface 11*a* is excited by electron gun 14. To overcome the difference of brightness, the current density of an electron beam landing on a fluorescent substance at the central portion is reduced to lower the brightness of the central portion. In this case, the brightness of the overall image formed by the CRT is lowered. When it is desired to improve the brightness of the image, since the sense of flatness of the outer surface of the panel 11 and the convergence correction of the deflection yoke 15 corresponding to the curvature of the inner surface of the inner surface of the panel 11 must be taken into consideration, the design of the panel 11 is particularly complex.

The present invention will now be described with reference to FIG. 3. A cathode ray tube 20 that has been constructed according to the principles of the present invention includes a panel 30 having a fluorescent film 31*b* formed on the inner surface thereof and a funnel 22 coupled to the panel 30 to form a seal. Electron gun 23 is installed inside of the neck 22*a* of funnel 22. A deflection yoke 24 for deflecting an electron beam emitted from electron gun 23 is installed at a cone portion 22*b* of funnel 22.

Figure 3:
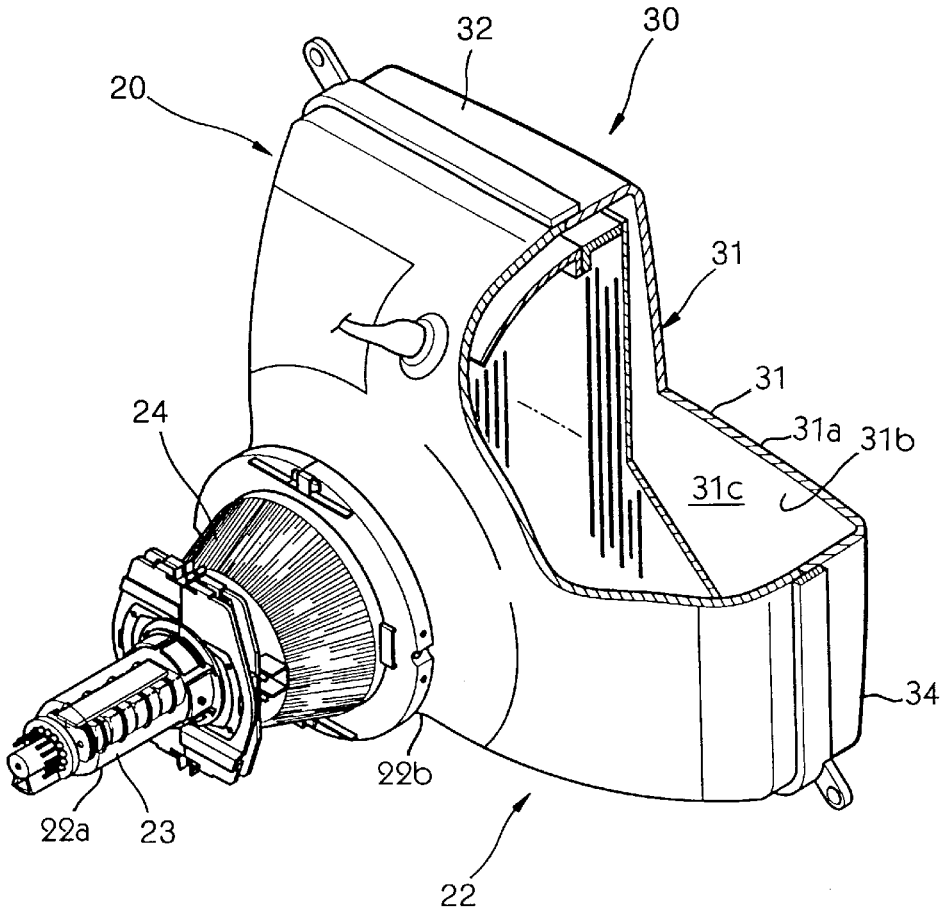
FIG. 3 is a partially cut-away perspective view of a CRT constructed according to the principles of the present invention.

With an electron beam emitted from electron gun 23 of CRT 20 having the structure of panel 11 illustrated by FIG. 3, any reduction in the angle of deflection by the deflection yoke 15 is advantageous in providing correction of convergence attributable to deflection yoke 15. When the curvature of inner surface 31*c* of panel 30 is lowered however, in order to reduce the angle of incident at which the electron beam generated by electron gun 23 lands on fluorescent film 31*b* and brightness is maintained across screen surface 31, the radius of curvature of the outer surface 31*a* of the panel also becomes smaller, and the sense of flatness of the screen surface tends to be lost. Accordingly, both the sense of increased flatness of screen surface 31 and a correction of convergence should be satisfied while the difference in brightness between the central portion and the peripheral portion of the viewing surface of screen surface 31 provided by panel 30 is minimized.

Figure 4:
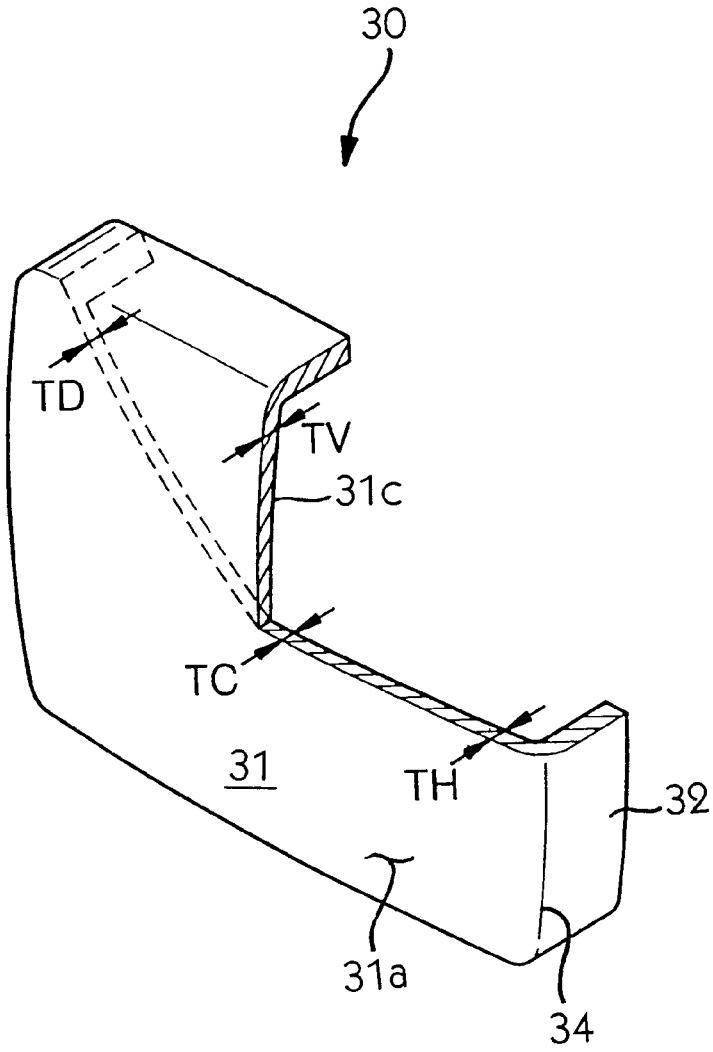
FIG. 4 is a partially cut-away perspective view of a panel that may be used in the construction of the cathode ray tube shown in FIG. 3.

As is shown in FIGS. 3 and 4, when constructed in accordance with the principles of the present invention, panel 30 includes screen surface 31 exhibiting predetermined radii of curvature of its inner and outer surfaces 31*c*, 31*a*, with skirt 32 extending transversely from the edge 34 of screen surface 31. Here, the length of screen surface 31 of panel 30 as measured along a diagonal direction of screen surface 31 is fifty-one centimeters, or more, and the radius of curvature of outer surface 31*a* of the effective viewing area of screen surface 31 is 1,450 millimeters, or more. The area corresponding to the effective viewing area of screen surface 31 is formed to have different radii of curvature for the inner and outer surfaces 31*a*, 31*c* so that these thicknesses in different portions of the screen surface are formed to be different. That is, when the diagonal radius of curvature of the outer surface of the effective screen area is set to be 1,450 millimeters or more, assuming that the thickness of panel 30 at the center of the central portion of the effective screen area is TC, the thickness of panel 30 at the edge of a vertical passing through the central portion is TV, the thickness of panel 30 at the edge of a horizontal passing through the central portion is TH, and the thickness of panel 30 at the edge of a diagonal passing through the central portion is TD, then the values of the thicknesses are formed to satisfy the expression of inequality:

$$(TH-TC)+(TV-TC)+(TD-TC)<TC/3 \quad (1)$$

Here, the values of TH/TC, TV/TC, and TD/TC are preferably values which are greater than or equal to 0.9 and less than or equal to 1.1. That is, $$0.9 \leqq TH/TC \leqq 1.1 \quad (2)$$

$$0.9 \leqq TV/TC \leqq 1.1 \quad (3)$$

and $$0.9 \leqq TD/TC \leqq 1.1 \quad (4)$$

This means that the thickness of the peripheral portion in each of the directions is greater or less than the thickness of the central portion, by within ±10%.

The minimum value of the values of TH/TC, TV/TC, and TD/TC is set to 0.9 based on the result of analysis of stress. That is, if the thickness of the peripheral portion is formed to be thinner by 10% or more than the thickness of the central portion, the maximum stress value is greater than an experimental threshold value of 90 kgf/cm$^2$. In particular, since stress is concentrated on a vertical edge portion of the panel 30 of the CRT, if the thickness of this portion is thinner than the central portion by 10% or more, there is a critical possibility of implosion.

The maximum value of the values of TH/TC, TV/TC, and TD/TC is set to 1.1 because the sense of mechanical flatness of panel 30 is determined by curvature of the outer surface, and the emotional sense of flatness perceived by the human visual system is based on a combination of the outer surface and the inner surface of the panel. That is, since the image formed on the screen surface of a flat type panel appears to be raised at the peripheral portion relative to the central portion, for the optimal curvature of the inner surface, the thickness of the peripheral portion should be formed thicker by about 10% than the central portion of panel 30 so that an ideal sense of flatness may be obtained.

In condition of the maximum stress value and the ideal sense of flatness, the values of TH, TV, TD and TC are set as:

$$TH/TC<1.0, \quad (5)$$

$$TV/TC<1.0, \quad (6)$$

and $$TD/TC<1.0, \quad (7)$$

and the relationship between the TH, TV and TD should preferably satisfy the following inequalities, $$TV>TH \quad (8)$$

and $$TV>TD, \quad (9)$$

in order to reduce the weight of the cathode ray tube by reducing the thickness of the peripheral portion of the panel, and to assure that the maximum value of stress is less than 90 kgf/cm$^2$. When the thickness of the edge portion of the effective screen area of panel 30 is less than the central portion, since the portion where stress is most concentrated is the vertical edge portion, making the thickness of the vertical edge portion of panel 30 as the thickest of the edge portions TH, TD provides the most stable design against explosion.

Also, when the thicknesses of the horizontal and vertical edge portions of panel 30 are less than the thickness of the central portion TC, since TV/TC should be greater by at least 2% than TH/TC and TD/TC, a stable design against implosion is possible when the values of TH and TD are the minimum thicknesses. That is, when:

$$TV/TC > TH/TC + 0.02 \quad (10)$$

or when:

$$TV/TC > TD/TC + 0.02 \quad (11)$$

a stable design is obtained.

The results of setting the differences in thickness of the panel in accordance with the principles of the present invention can be clarified by the following example.

EXAMPLE 1

In this example, the maximum stress value attributable to differences in thicknesses of the central portion and the diagonal edge portion, the horizontal edge portion, and the vertical edge portion of the panel are shown by Table 1.

TABLE 1

| | TH/TC × 100 | TV/TC × 100 | TD/TC × 100 | Maximum stress value (kgf/cm$^3$) |
|---|---|---|---|---|
| 1 | 100 | 100 | 100 | 79.5 |
| 2 | 95 | 100 | 100 | 79.9 |
| 3 | 90 | 100 | 100 | 80.3 |
| 4 | 100 | 95 | 100 | 86.5 |
| 5 | 100 | 90 | 100 | 94.1 |
| 6 | 100 | 100 | 95 | 80.0 |
| 7 | 100 | 100 | 90 | 80.4 |
| 8 | 90 | 95 | 90 | 88.3 |
| 9 | 90 | 92 | 90 | 91.3 |

In Table 1, the maximum stress value is obtained only when the thickness TH of the horizontal edge portion or the thickness TV of the vertical edge portion is thinner than the thickness TC of the central portion. When the thicknesses TH and TV of the horizontal or vertical edge portions are thicker than the thickness TC of the central portion, no problem is caused because the value of maximum stress is sufficiently small. As indicated by Table 1, when the thickness of any portion is less than the central portion, it can be seen that the maximum stress value gradually increases. In particularly, when the thickness of the vertical edge portion is thinner than the central portion by about 10%, the maximum stress value exceeds an experiential threshold value of 94 kgf/cm$^2$. Consequently, in designing the thicknesses of the panel to avoid implosion, the thickness of the peripheral portion of the panel should not be less than the thickness of the central portion by 10% or more.

Typical contemporary panels are manufactured with TV/TC is the ranges of 1.1 to about 1.3, TH/TC within the range of 1.2 to 1.5 and TD/TC within the range of 1.4 to about 2.0; consequently (TH−TC)+(TV−TC)+(TD−TC) with contemporary practice could be described as:

$$0.7 \times TC < (TH-TC)+(TV-TC)+(TD-TC) < 2.8 \times TC \quad (12)$$

In the manufacture of a panel for a cathode ray tube according to the principles of the present invention however, by limiting the difference in thickness between the central portion and the peripheral portion of the effective screen area of the panel and the radius of the curvature of the inner and outer surfaces of the effective screen, the weight of the panel is reduced and an increase in the incident angle caused by the consequent greater flatness of the screen panel is prevented so that the convergence of an electron beam is improved. Also, the emotional sense of flatness of the screen surface is improved.

It is noted that the present invention is not limited to the preferred embodiment described above, and it is apparent that variations and modifications by those skilled in the art can be effected within the spirit and scope of the present invention defined in the appended claims.

What is claimed is:

1. A panel for a cathode ray tube, comprising:

a screen surface region, comprising:

an inner surface;

an outer surface; and an edge disposed between said inner surface and said outer surface; and a skirt region extending from the edge of the screen surface region;

the panel being shaped so as to define a thickness of a central portion of the screen surface region, a thickness of the edge along a vertical to the central portion, a thickness of the edge along a horizontal to the central portion, and a thickness of the edge along a diagonal to the central portion, said thicknesses satisfying the expression of inequality (TH−TC)+(TV−TC)+(TD−TC)<TC/3, wherein TH is said thickness of the edge along said horizontal to the central portion, TC is said thickness of the central portion of the screen surface, TV is said thickness of the edge along said vertical to the central portion, and TD is said thickness of the edge along said diagonal to the central portion; and a radius of curvature of said outer surface along said diagonal is greater than 1450 mm, and said radius of curvature of said outer surface along said diagonal does not equal a radius of curvature of said inner surface along said diagonal.

2. The panel of claim 1, further comprises of a value of TH/TC being greater than or equal to 0.9 and less than or equal to 1.1.

3. The panel of claim 1, further comprised of a value of TH/TC being greater than or equal to 0.9 and less than or equal to 1.0.

4. The panel of claim 1, further comprised of a value of TV/TC being greater than or equal to 0.9 and less than or equal to 1.1.

5. The panel of claim 1, further comprised of a value of TV/TC being greater than or equal to 0.9 and less than or equal to 1.0.

6. The panel of claim 1, further comprised of a value of TD/TC being greater than or equal to 0.9 and less than or equal to 1.1.

7. The panel of claim 1, further comprised of a value of TD/TC being greater than or equal to 0.9 and less than or equal to 1.0.

8. The panel of claim 1, further comprised of each of the values of TH/TC, TV/TC and TD/TC being greater than or equal to 0.9 and less than or equal to 1.1.

9. The panel of claim 1, further comprised of each of the values of TH/TC, TV/TC and TD/TC being greater than or equal to 0.9 and less than or equal to 1.0.

10. The panel of claim 9, further comprised of a value of TV being greater than a value of TH, and said value of TV being greater than a value of TD.

11. The panel of claim 1, further comprised of an expression of inequality TV/TC>TH/TC+0.02 being satisfied.

12. The panel of claim 1, further comprised of a linear dimension of said screen surface along said diagonal being greater than or equal to 51 cm.

13. The panel of claim 1, further comprised of an expression of inequality TV/TC>TD/TC+0.02 being satisfied.

14. A panel for a cathode ray tube, comprising:

a screen surface region, comprising:

an inner surface;

an outer surface separated by a mass of said panel from said inner surface; and an edge disposed between said inner surface and said outer surface defining a periphery of said screen surface region; and a skirt extending from the edge;

said panel being shaped to define a thickness TC of said screen surface region at a central portion of the screen surface region, a thickness TV of said screen surface region along a vertical to the central portion, a thickness TH of said screen surface region along a horizontal to the central portion, and a thickness TD of said screen surface region along a diagonal to the central portion, and to conform to an expression of inequality:

$$(TH-TC)+(TV-TC)+(TD-TC)<TC/3,$$

a radius of curvature of said outer surface along said diagonal is greater than 1450 mm, and said radius of curvature of said outer surface along said diagonal does not equal a radius of curvature of said inner surface along said diagonal.

15. The panel of claim 14, further comprises of a value of TH/TC being greater than or equal to 0.9 and less than or equal to 1.1.

16. The panel of claim 14, further comprised of a value of TV/TC being greater than or equal to 0.9 and less than or equal to 1.1.

17. The panel of claim 14, further comprised of a value of TD/TC being greater than or equal to 0.9 and less than or equal to 1.1.

18. The panel of claim 14, further comprised of each of the values of TH/TC, TV/TC and TD/TC being greater than or equal to 0.9 and less than or equal to 1.1.

19. The panel of claim 14, further comprised of a value of TV being greater than a value of TH, and said value of TV being greater than a value of TD.

20. A process for manufacturing a panel for a cathode ray tube, comprising:

making said panel with a screen surface region comprised of:

an inner surface;

an outer surface;

an edge disposed between said inner surface and said outer surface; and forming a skirt region extending from the edge of the screen surface region;

shaping said panel so as to define a thickness of a central portion of the screen surface region, a thickness of the edge along a vertical to the central portion, a thickness of the edge along a horizontal to the central portion, and a thickness of the edge along a diagonal to the central portion, with said thicknesses satisfying the expression of inequality (TH−TC)+(TV−TC)+(TD−TC)<TC/3, wherein:

TH is said thickness of the edge along said horizontal to the central portion, TC is said thickness of the central portion of the screen surface, TV is said thickness of the edge along said vertical to the central portion, and TD is said thickness of the edge along said diagonal to the central portion; and a radius of curvature of said outer surface along said diagonal is greater than 1,450 millimeters, and said radius of curvature of said outer surface along said diagonal does not equal a radius of curvature of said inner surface along said diagonal.

* * * * *